US005273327A

United States Patent [19]

Johnson et al.

[11] Patent Number: 5,273,327

[45] Date of Patent: Dec. 28, 1993

[54] HATCHBACK DOOR FOR AN AUTOMOBILE

[75] Inventors: Randall E. Johnson, Milford, Mich.; Yutaka Morita, Kanagawa, Japan

[73] Assignee: Nissan Research and Development, Farmington Hills, Mich.

[21] Appl. No.: 841,995

[22] Filed: Feb. 28, 1992

[51] Int. Cl.[5] ..... E05C 3/26

[52] U.S. Cl. ..... 292/336.3; 292/DIG. 65; 292/DIG. 43

[58] Field of Search ..... 292/97, 123, 196, 216, 292/223, 336.3, DIG. 43, DIG. 65, 280

[56] References Cited

U.S. PATENT DOCUMENTS

| | | | |
|---|---|---|---|
| 2,423,937 | 7/1947 | Humer | 292/DIG. 43 |
| 2,725,248 | 11/1955 | Rimkus | 292/DIG. 43 X |
| 2,767,571 | 10/1956 | Dingman et al. | 292/DIG. 43 X |
| 3,400,491 | 9/1968 | Hole | 292/62 |
| 3,776,588 | 12/1973 | Sobajima et al. | 292/146 |
| 4,056,280 | 11/1977 | Bauer et al. | 296/146 |
| 4,341,414 | 7/1982 | Chiba | 296/56 |
| 4,382,622 | 5/1983 | Ishikawa | 292/216 |
| 4,438,969 | 3/1984 | Kamijo et al. | 296/146 |
| 4,462,633 | 7/1984 | Maeda | 296/188 |
| 4,753,475 | 6/1988 | Mochida | 296/192 |
| 4,773,683 | 9/1988 | Nakamura | 292/216 |
| 4,956,943 | 9/1990 | Yamada et al. | 49/503 |
| 4,995,654 | 2/1991 | Nishigami et al. | 292/216 |
| 5,069,493 | 12/1991 | Mochida et al. | 292/DIG. 65 |

*Primary Examiner*—Richard E. Moore

*Attorney, Agent, or Firm*—Lowe, Price, LeBlanc & Becker

[57] ABSTRACT

A hatchback door for an automobile hinged at its upper end to a body of the automobile includes an outer panel having a handle to open the hatchback door; an inner panel connected to the outer panel, the inner panel having an opening immediately in front of the handle; a door lock assembly mounted at the lower end of the door; and a rod assembly provided between the inner panel and the outer panel connecting the handle and the door lock assembly.

7 Claims, 3 Drawing Sheets

Figure 1: Prior Art
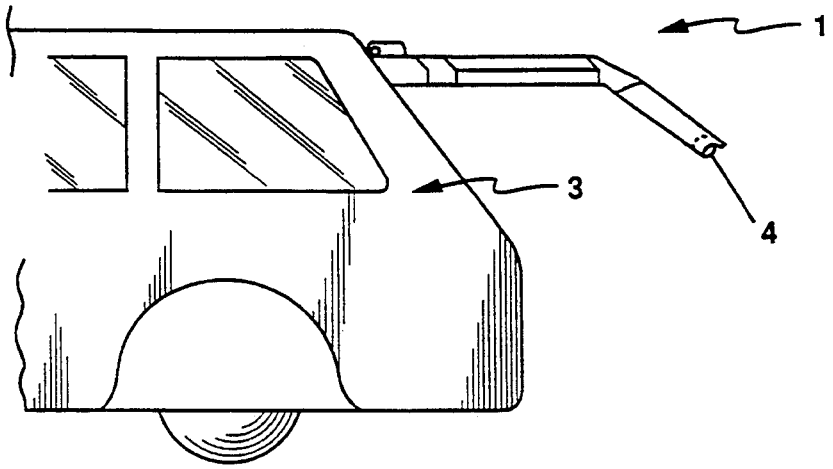
Figure 2: Prior Art
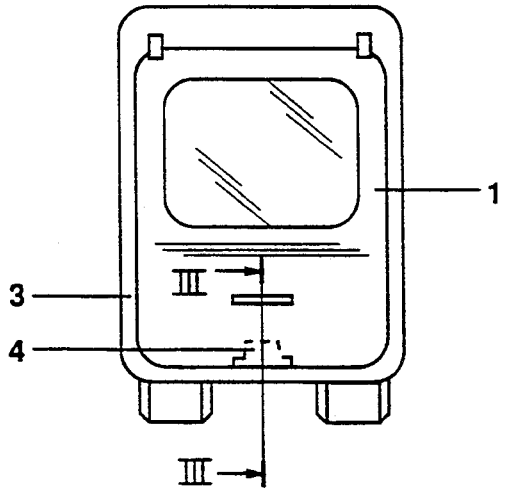
Figure 5
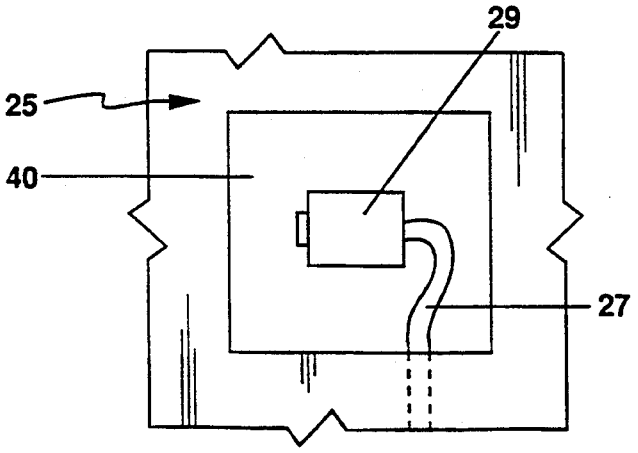

Figure 3: Prior Art
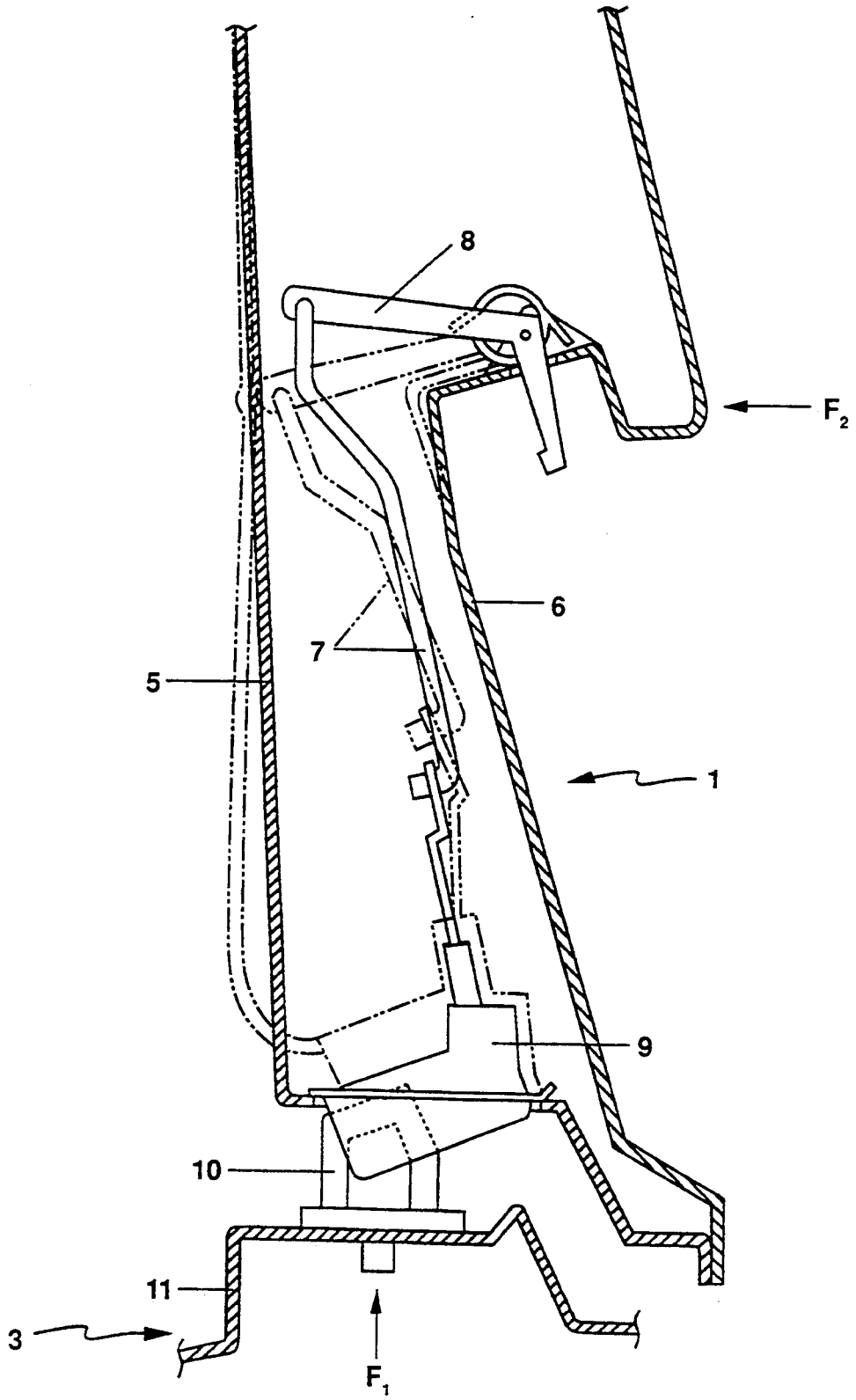

HATCHBACK DOOR FOR AN AUTOMOBILE

BACKGROUND OF THE INVENTION

The present invention relates to a hatchback door for an automobile, and more specifically to a hatchback door structure that reduces the likelihood of opening of the hatchback door if the automobile is involved in a rear-end impact.

FIGS. 1–3 show a conventional hatchback door of an automobile. Such a hatch back door is shown in U.S. Pat. No. 4,773,683. Hatchback door 1, as shown in FIG. 1, is a back door of a delivery van type motor vehicle. Door 1 is hinged at its upper end to a vehicle body 3 to open and close a back opening of the vehicle. In order to releasably hold door 1 in its closed position, a lock device 4 is mounted thereon. The lower part of door 1 is shown in FIG. 3. as a sectional view. It comprises an inner panel 5 and outer panel 6. A rod 7 is provided in a space between the inner panel and outer panel, connecting a L-shaped handle 8 mounted on the outer panel with door lock assembly 9. A striker 10 is mounted on a rear member 11 of vehicle body 3. Door lock assembly 9 catches striker 10 to keep door 1 closed. When handle 8 is pulled and rod 7 moves downward to exceed a threshold stroke, door lock assembly 9 releases striker 10 in an unlatching action and the door opens.

Due to its inherent construction, the above-mentioned conventional door 1 may result in unlatching under some conditions involving a rear-end impact on the automobile. Thus, the first impact upon the rear bumper forces door lock assembly 9 to move upward, while the second impact on door 1 forces the outer panel 6 to be distorted forward. As a result, the front end of the handle 8 strikes inner panel 5, causing handle 8 to be distorted downward as shown in broken line in FIG. 3. When this happens, the relative distance between the front end of handle 8 and door lock assembly 9 becomes shorter. At the moment the amount of relative movement between handle 8 and door lock assembly 9 exceeds the threshold stroke, the lock assembly releases the striker 10 and door 1 opens.

In order to reduce the likelihood of the hatchback door opening because of a rear-end impact on the automobile this invention provides a hatchback door for an automobile hinged at its upper end to a body of the automobile comprising an outer panel having a handle to open the hatchback door; an inner panel connected to the outer panel, the inner panel having an opening in front of the handle; a door lock assembly mounted at the lower end of the door; and a rod assembly provided between the inner panel and the outer panel connecting the handle and the door lock assembly.

BRIEF DESCRIPTION OF THE DRAWINGS

FIG. 1 is a side view of a delivery van type automobile equipped with a conventional hatchback door.

FIG. 2 is a rear view of the automobile of FIG. 1.

FIG. 3 is a sectional view of the lower part of the hatch back door, taken along the line III—III of FIG. 2.

FIG. 5 is a rear view of opening 40, taken along the line V—V of FIG. 4, when looking down the axis of handle 28.

DETAILED DESCRIPTION OF THE INVENTION

Figure 4:
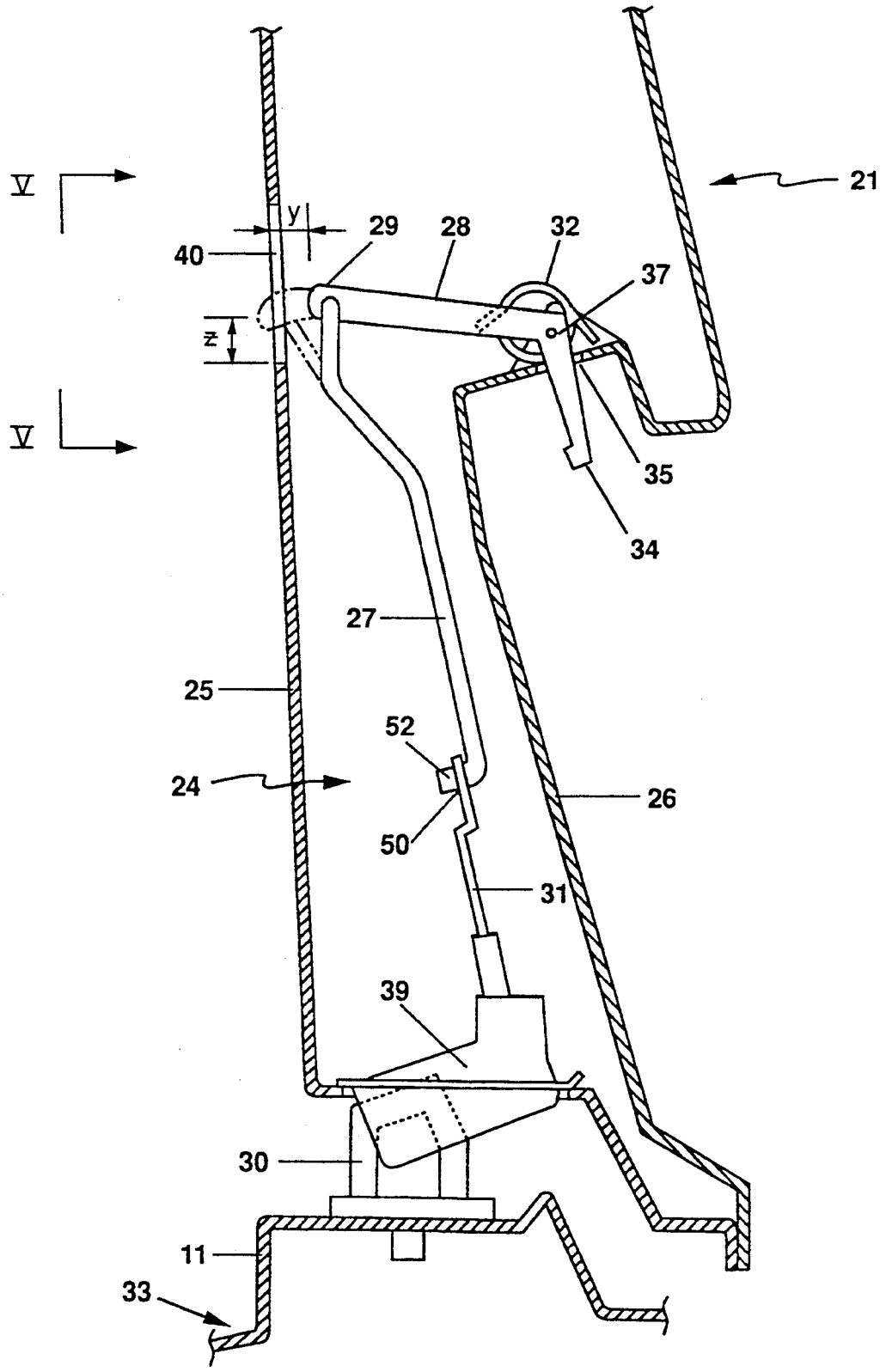
FIG. 4 is a sectional view of the lower part of the hatch back door of the present invention.

Referring to FIG. 4, a hatchback door of an automobile according to this invention is shown. This door is hinged at its upper end to the body in the same manner as conventional hatchback door.

An inner panel 25 and an outer panel 26 are combined to form a door 21 that has an inner space 24 between inner panel 25 and outer panel 26. Outer panel 26 faces the rear of the automobile and inner panel 25 faces the passenger's compartment. In inner space 24 an L-shaped handle 28 is mounted on outer panel 26. Handle 28 is supported by a pivot pin 37 so that it may rotate about this pin. One end 29 of handle 28 extends forward and the other end 34 extends through a guide hole 35 in outer panel 26. A coil spring 32 arranged around pivot pin 37 biases the handle 28 towards its inoperative or rest position, that is in a clockwise direction, as shown in FIG. 4. An opening 40 is provided in inner panel 25 immediately in front of forward end 29 of handle 28.

A conventional door lock assembly 39 is mounted at the lower end of the door 21. This assembly has an extension rod 31 extending upward, with an opening 50 at its upper end. The lower end 52 of rod 27 is inserted through opening 50. The upper end of rod 27 is pivottably connected in conventional manner to forward end 29 of handle 28.

When door 21 is closed and handle 28 is in its rest position, door lock assembly 39 catches a striker 30 mounted on a rear cross member 11 of vehicle body 33. When handle 28 is operated in a counterclockwise direction, rod 27 forces the extension rod 31 to move downward. When the stroke of extension rod 31 exceeds the threshold stroke, door lock assembly 39 releases striker 30, thereby opening door 21.

If the vehicle is struck because of a rear impact, door lock assembly 39 moves upward and outer panel 26 is thrust forward. In such event, forward end 29 of handle 28 is forced through opening 40 in inner panel 25. Since the forward end 29 of handle 28 does not touch inner panel 25, however, handle 28 will not distort downward so that the relative movement between forward end 29 of handle 28 and door lock assembly 39 does not exceed the threshold stroke for releasing striker 30 upon impact on the vehicle. Thus, door 21 will be less likely to open upon impact due to latch disengagement than in prior art door assemblies and the contents of the rear compartment of the vehicle will remain inside the vehicle upon impact. Opening 40 may be made large enough to be able to have a tool access for installation of trim parts on the back door, or for weight savings of inner panel 25, or for manufacturing of sheet metal assembly.

The distance y is defined as the distance between the rearward face of inner panel 25 to front end 29 of handle 28. The distance z is defined as the distance between the bottom portion of front end 29 of handle 28 to the lower rim of opening 40. Door 21 reduces the likelihood of its latch opening if the area of forward end 29 of handle 28 moves forward and enters the area made by opening 40, thereby causing the bottom of forward end 29 to strike the lower rim of opening 40 of inner panel 25 by restraining the handle 28 or producing a fracture of handle 28. Before a rear-end impact (as best seen in FIG. 4), the distance y would be very small, so that the lower rim of opening 40 will restrain handle 28 instantaneously upon a rear impact on the automobile. Therefore, deflection of rod 27 will also be very small, thus preventing rod 27 from moving downward and exceeding the threshold stroke.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A hatchback door of an automobile hinged at its upper end to a body of the automobile comprising:

an outer panel having a handle to open said hatchback door;

an inner panel connected to said outer panel;

a door lock assembly mounted to the lower end of said hatchback door;

a rod assembly provided between said inner panel and said out panel connecting a forward end of said handle and said door lock assembly; and an opening provided in said inner panel immediately in front of the forward end of said handle so that a relative movement between the forward end of said handle and said door lock assembly, in the event the automobile is impacted and said handle is thereby forced forwardly, does not exceed a threshold stroke for releasing said door lock.

2. A hatchback door as claimed in claim 1, wherein: said handle is L-shaped.

3. A hatchback door as claimed in claim 1, wherein: said handle is mounted above said door lock assembly.

4. A hatchback door as claimed in claim 1, wherein: the area of said opening is larger than the area of said forward end of said handle.

5. A hatchback door as claimed in claim 1, wherein: said opening has an upper rim and a lower rim and the forward end of said handle has a stoke, the length of a stroke being determined by an open position and a closed position of said handle, and the length of said opening from said lower rim to said upper rim is larger than said stroke, whereby said opening does not impede a forward movement of said forward end of said handle if said handle is forced forward due to a rear-end impact on the automobile.

6. A hatchback door as claimed in claim 1, wherein: door lock assembly is connectable to a striker mounted on the body of said automobile.

7. A hatchback door of an automobile, comprising;

a pair of connected door panels defining a space therebetween, the first of said panels having an opening therein;

a handle mounted on the second of said panels immediately behind said opening in said first door panel;

a lock assembly mounted on the lower part of said panels; and a rod assembly connecting said door handle and said lock assembly;

wherein said handle has an operating stroke and said opening has a vertical dimension larger than said stroke, so that an unimpeded forward motion of said handle is permitted forwardly into said opening if the hatchback door is involved in a rear-end impact of the automobile, the handle thereby retaining the lock assembly in a locked state and preventing the hatchback door from opening.

* * * * *